US005971214A

United States Patent [19]

Bettison, Jr.

[11] Patent Number: 5,971,214

[45] Date of Patent: Oct. 26, 1999

[54] CHILD RESISTANT, SPRAY THROUGH OVERCAP, AEROSOL SPRAY APPARATUS

[76] Inventor: William L. Bettison, Jr., Alto Prado Building El Condor Floor 12, Apt B12, Caracas, Venezuela

[21] Appl. No.: 09/226,488

[22] Filed: Jan. 7, 1999

Related U.S. Application Data

[63] Continuation-in-part of application No. 08/967,384, Nov. 6, 1997.

[51] Int. Cl.[6] ..... B65D 83/14

[52] U.S. Cl. ..... 222/153.11; 222/402.11; 222/402.13

[58] Field of Search ..... 222/153.11, 153.13, 222/402.11, 402.13, 402.17

[56] References Cited

U.S. PATENT DOCUMENTS

| | | | |
|---|---|---|---|
| 2,610,940 | 9/1952 | Endicott | 222/402.11 X |
| 2,715,481 | 8/1955 | McGhie et al. | 222/153.11 |
| 2,752,066 | 6/1956 | Ayres | 222/402.11 |
| 2,757,826 | 8/1956 | Thomas | 222/402.11 |
| 2,772,819 | 12/1956 | Poarch et al. | 222/402.11 |
| 2,997,243 | 8/1961 | Kolb | 222/402.11 X |
| 3,050,219 | 8/1962 | Sagarin et al. | 222/402.11 X |
| 3,062,417 | 11/1962 | Sullivan et al. | 222/402.11 |
| 3,133,680 | 5/1964 | Sliwinski | 222/402.11 |
| 3,149,757 | 9/1964 | Safianoff | 222/153.11 |
| 3,180,536 | 4/1965 | Meshberg | 222/402.11 |
| 3,426,948 | 2/1969 | Stirling | 222/402.11 |
| 3,484,023 | 12/1969 | Meshberg | 222/402.11 |
| 3,591,128 | 7/1971 | Ramis | 251/100 |
| 3,601,290 | 8/1971 | Nigro | 222/402.11 |
| 3,606,966 | 9/1971 | Rait | 222/402.11 |
| 3,721,423 | 3/1973 | Shay | 222/402.11 X |
| 3,738,536 | 6/1973 | Gach | 222/153 |
| 3,779,427 | 12/1973 | Ewald | 222/153 |
| 3,797,705 | 3/1974 | Cooprider | 222/153 |
| 3,860,149 | 1/1975 | Hagianis | 222/153.11 |
| 4,024,995 | 5/1977 | Landen et al. | 222/402.11 |
| 4,065,036 | 12/1977 | Kirk, Jr. | 222/402.11 X |
| 4,418,842 | 12/1983 | DiLoreto | 222/153 |
| 4,420,090 | 12/1983 | Kirk, Jr. | 222/402.11 X |
| 4,735,346 | 4/1988 | Stoody | 222/153 |

*Primary Examiner*—Kevin P. Shaver
*Attorney, Agent, or Firm*—Richard M. Saccocio P.A.

[57] ABSTRACT

Safety apparatus is provided which is adaptable to an aerosol spray can such that spraying can occur only in one direction or in a limited number of desired directions. The direction of spraying is in accordance with a feature on a spray head and a mating feature on a mounting cup, when mating alignment is achieved spraying can occur. When the spray head and the mounting cup are out of mating alignment spraying cannot occur.

6 Claims, 6 Drawing Sheets

CHILD RESISTANT, SPRAY THROUGH OVERCAP, AEROSOL SPRAY APPARATUS

CROSS REFERENCE TO RELATED APPLICATIONS

This is a continution in part of U.S. application Ser. No. 08/967,384, filed Nov. 6, 1997.

BACKGROUND OF THE INVENTION a) Field of the Invention

This invention relates in general to the filed of aerosol spray cans activated by pressing downward on a spray head which opens a valve and releases the aerosol can contents during the time that the spray head is depressed, and in particular to safety spray can apparatus that prevent accidental release of the can contents and provides for spraying in one direction.

b) Description of the Prior Art

In today's marketplace the requirement for safe products has acquired a permanent place. The reason is two fold: to prevent injury to the user and to minimize economic loss sustained as a result of an injury. In the prior art, there exists a type of safety apparatus which allows a user to determine if the product has been tampered with. These usually comprise a plastic wrap which must first be removed before the product can be opened. There is another type of safety apparatus which makes it difficult to open the product. This type of safety apparatus is termed as "child resistant." The intent being to make the container difficult if not impossible for a child to open the product, yet allow an adult to open the product with relative ease. Many prescription drug containers are provided with this type of safety apparatus, so too are containers for non prescription products which are dangerous to children. The present invention is concerned with this latter type of safety apparatus by providing safer aerosol containers so as to reduce the risk of accidental injuries to both children and adults.

The convenience and economics of aerosol spray cans has led to very widespread use of this type of container to dispense a large variety of products. Oven cleaners, paints, air fresheners, insecticides, degreasers, and other types of household and industrial cleaners are but a few examples of such products which if accidently dispensed by a child or an adult in the wrong direction can cause serious injuries, some of which are even life threatening. There was a brief period of time when the propellant within a spray can caused damage to the environment which led to the use of pump spray containers, i.e., spray containers which did not rely upon the use of a propellant to dispense the product. However, recent advancements in technology have produced a type of propellant which will not damage the environment. This advancement has resulted in a resurgence of the use of aerosol spray cans. Manufactures and consumers alike simply prefer the convenience of aerosol spray cans. Unfortunately, the resurgence in the use of aerosol spray cans has again resulted in the possibly of accidental injuries.

Spray cans are actuated by simply pressing down on a member known as a spray head. The spray head includes an orifice which provides the desired type of spray consistent with the type of product being sprayed. Pressing down on the spray head opens or unseats a valve which allows the propellant and the product to flow through the spray head and out of the orifice. Since the can is pressurized, the product is sprayed with considerable force. It is therefore readily understood that a child can unknowingly cause the product to be sprayed directly into his or her face. Such accidental spraying can seriously injure a child given the highly hazardous chemical contents of some spray cans. In order to help prevent such an occurrence, manufacturers have provided some spray cans with an over-cap which prevents immediate access to the spray head. By making the over-cap difficult to be removed, it was hoped that injuries to children and adults would be prevented. While this prior art solution has some merit, it is not without problems. The over cap is an inconvenience to adults who sometimes throw the over-cap away after the can is initially used. Then too there are times when the over-cap is lost or misplaced which also defeats the safety aspect. In either event, any child or adult safety effectiveness is eliminated. Thus, this type of safety over cap, even those which require a pry bar such as a screw driver to pop off the cap in order to gain access to the spray head, are cumbersome and not particularly effective.

As noted above adults are also susceptible to serious injuries from aerosol spray cans. The prior art aerosol spray cans allow spraying of the product in any direction, even directly in to the face of the user. In order to lessen this type of accidental spraying, an adult user must make a conscious effort to determine the location of the spray orifice and then direct the spray orifice in the direction to be sprayed. It is readily envisioned that an older person or a distracted person, or a not-to-careful person can inadvertently cause the spray to be directed at the person instead of away from him or her. Other than the cumbersome prior art over-caps the inventor herein is not aware of any other type of safety apparatus which is presently being used with aerosol spray cans.

Accordingly, a primary object of the present invention provide safety apparatus for use with an aerosol spray can which aids in preventing accidental spraying by a child or an adult and does not consist of a one time use safety apparatus.

Another object of the present invention is to provide safety apparatus for use with an aerosol spray can which is simple to be used by an adult but not by a child.

Another object of the present invention is to provide safety apparatus for use with an aerosol spray can which is simple and inexpensive to manufacture.

Another object of the present invention is to provide safety apparatus for the use with an aerosol spray can which retains its effectiveness for the life of the product being sprayed.

Another object of the present invention is to provide an aerosol spray can which helps in avoiding injuries to a person during use of the spray can.

The above-stated objects as well as other objects which, although not specifically stated, but are intended to be included within the scope the present invention, are accomplished by the present invention and will become apparent from the hereinafter set forth Detailed Description of the Invention, Drawings, and the claims appended herewith.

SUMMARY OF THE INVENTION

The above objects as well as others are accomplished by the present invention which comprises uni-directional spray apparatus which is adapted to be used with an aerosol spray can. In one embodiment, a mounting cup is provided with one or more indentations or protrusions which respectively mate with a protrusion or indentation at the base of a spray head such that an alignment of the mating features must exist before the spray head can be depressed to initiate spraying.

In another embodiment, the can top is provided with the indentations which mate with an opposite counterpart at the base of a combined overcap and spray head. In yet another embodiment two or more protrusions are provided in the mounting cup while a single indentation is provided at the base of the spray head. In this latter embodiment the indentation in the spray head must be aligned with one on the protrusions or the mounting cup in order to allow the spray head to be depressed to initiate spraying. In still another embodiment, a single protrusion is provided almost completely around the circumferential base of the mounting cup while a single protrusion in combination with an angled circumferential edge of the spray head is provided. In the latter two embodiments, provided that the mating parts are properly aligned, the spray head is caused to tilt while being depressed which causes the spray valve to become open and thereby initiate spraying. Even a slight amount of misalignment prevents spraying.

In accordance with the above, there has been summarized some of the more important features of the present invention in order that the detailed description of the invention as it appears below may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
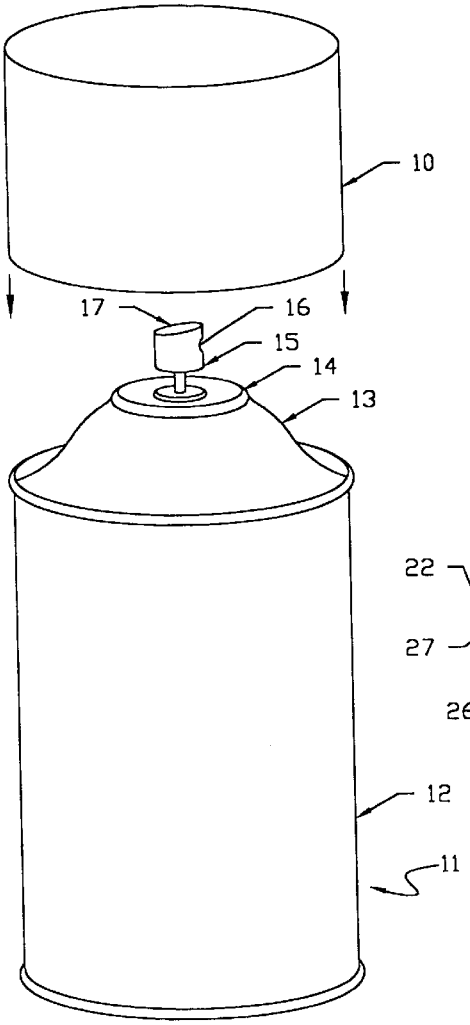
FIG 1 PRIOR ART
FIG. 1 is a view of a prior art aerosol spray can showing the various components thereof.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like the characteristics and features of the present invention shown in the various figures are designated by the same reference numerals.

FIGS. 1–8 show a typical prior art aerosol spray can and various components thereof. A brief description of the components and the operation thereof of prior art aerosol cans is helpful to better understand the invention herein. FIG. 1 schematically depicts a typical prior art aerosol spray can 11 which comprises a container member 12 which contains the product to be sprayed and the propellant. The upper portion of the spray can 11 includes a can top 13, a mounting cup 14, a spray head 15, and an overcap 10. In operation of the prior art spray can 11, the spray head is depressed or pushed down which opens a valve resulting in the product and propellant being sprayed through an orifice 16 in the spray head 15. The spray head 15 is simply pressed onto or into the mounting cup 14 and is therefore rotatable relative to the mounting cup 14; accordingly spraying can be initiated regardless of the rotational position of the spray head 15 relative to the mounting cup 14. In other words spraying can occur for a full 360 degrees. Usually the spray head 15 includes an angled upper surface 17 to assist the person in directing the spray in a desired direction. However, other than the angled surface 17, there is nothing in general use in the prior art to prevent a person or child from accidentally spraying the can contents directly to the face of the person or child. Obviously a child would have no knowledge of the intent of the angled surface 17. The present invention is intended to lessen this possibility.

Figure 2:
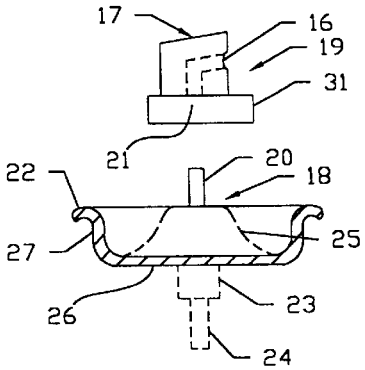
FIG 2 PRIOR ART
FIG. 2 is a composite view of a female spray cap in association with a male mounting cup of the prior art.

FIG. 2 schematically depicts the details of a male mounting cup 18 and an accompanying female spray head 19. A male stem 20 fits within an opening 21 in spray head 19. When spray head 19 is fitted to the mounting cup 18 and is depressed, the valve 23 is opened and allows flow through the tube 24 and out of female spray head 19. A flange 22 is designed to be crimped around a mating bead on the can TOP13 and provide a sealing joint. Valve 23 is sealingly fitted within a raised cylindrical portion or pedestal 25 of mounting cup 18. It is to be noted that the valve used with aerosol spray cans are also termed male or female. However, this distinction is of no consequence to the present invention. Hence, the word valve as used herein applies whether the valve is male or female. A circumferential crimp seals and fixedly attaches the valve 23 within the pedestal 25. An angled base 26 of mounting cup 18 extends between the outer cylindrical wall 27 and the pedestal 25 of mounting cup 18.

Figure 3:
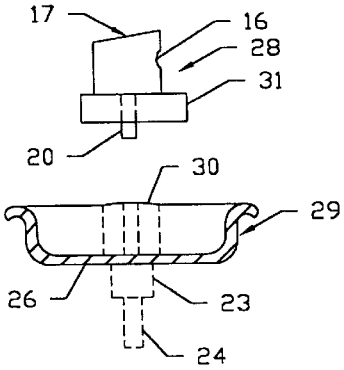
FIG 3 PRIOR ART
FIG. 3 is a composite view of a male spray head in association with a female mounting cup of the prior art.

FIG. 3 schematically illustrates a male spray head 28 and a female mounting cup 29. A valve 23 is also used which is crimped within pedestal 25. Instead of an angled base, a flat base 26 is used for the female mounting cup 29. The spraying operation of a can 11 fitted with the apparatus of FIG. 2 or FIG. 3 is exactly the same. Hence, spraying can occur in a full 360 degrees of rotation of spray head 28 relative to mounting cup 29.

Figure 4:
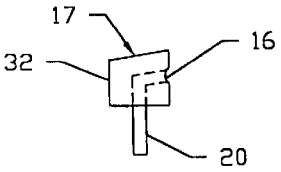
FIG 4 PRIOR ART
FIG. 4 is a view of a male, non skirted, small spray head of the prior art.
Figure 5:
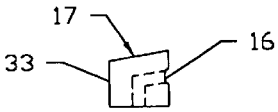
FIG 5 PRIOR ART
FIG. 5 is a view of a female, non-skirted, small spray head of the prior art.

FIGS. 2 and 3 schematically depict spray heads 19 and 28, having a skirt 31 extending downward from the spray heads. FIGS. 4 and 5 depict non-skirted spray heads 32 and 33. The only difference between the prior art designs shown in FIGS. 4 and 5 compared to FIGS. 2 and 3 is one of aesthetics, the skirt 31 covers the entire inside of the respective mounting cup when assembled. The spraying operation of the prior art designs shown in FIGS. 2–5 are exactly the same.

Figure 6:
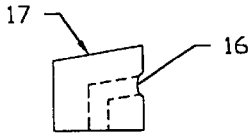
FIG 6 PRIOR ART
FIG. 6 is a view of a female, non-skirted medium sized spray head of the prior art.

FIG. 6 depicts a medium sized prior art female spray head 34. FIGS. 1, 4 and 5 on the other hand show small sized spray heads.

Figure 7:
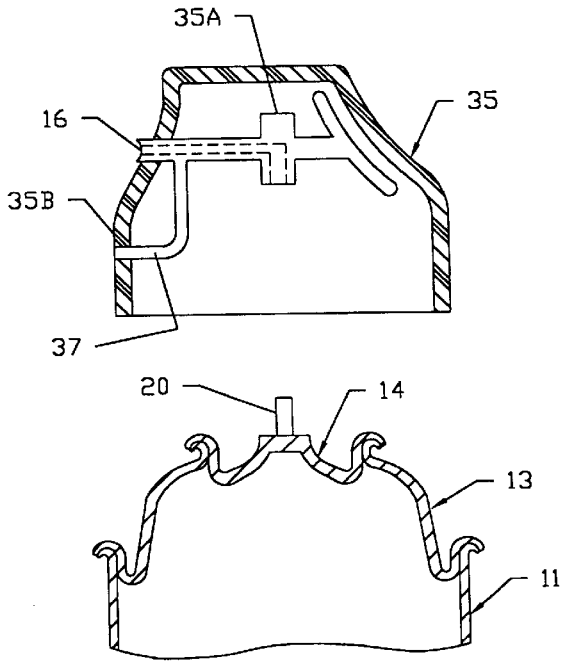
FIG 7 PRIOR ART
FIG. 7 is a composite view of one combination spray through overcap of the prior art.
Figure 8:
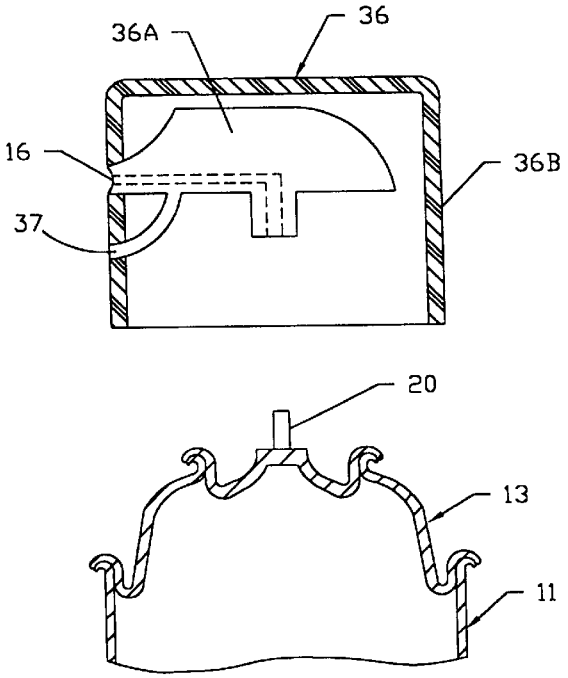
FIG 8 PRIOR ART
FIG. 8 is a composite view of another combination spray through overcap of the prior art.

FIGS. 7 and 8 schematically illustrate other aesthetic variations of the spraying mechanisms of prior art spray cans. In these prior art designs a combined overcap and spray head 35 or 36 which is termed a spray through overcap is used to cover the top of can 11. An activator mechanism 35A or 36A is used to push forward and depress a male valve stem 20 which opens the spray valve (not shown) and allows spraying through an orifice 16. A hinged joint 37 connects the spray heads to the cover 35B or 36B.

The present invention provides new and novel spray heads, mounting cups and overcaps for use with aerosol spray cans to render the aerosol spray can safer and greatly reduce or eliminate accidental operation of an aerosol spray can when purposeful operation is not intended. The present invention also eliminates multi direction spraying so that spraying in an accidentally wrong direction is lessened or prevented.

Figure 10:
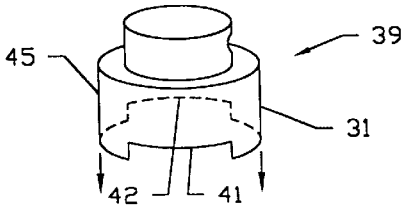
FIG. 10 is a side view of a female mounting cup according to the present invention.
Figure 10:
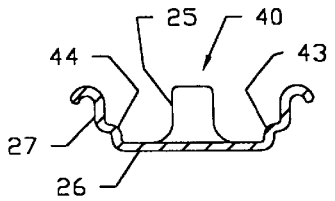
Figure 9:
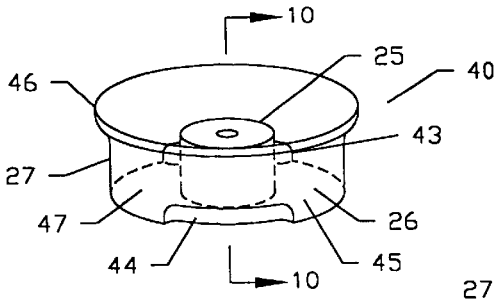
FIG. 9 is a composite view of one embodiment of a spray head and mounting cup of the present invention.

FIG. 9 schematically shows one embodiment of a novel skirted spray head 39 in conjunction with its mating and novel mounting cup 40. Spray head 39 and mounting cup 40 may be of the male-female type respectively or vice versa. As can be seen the skirted spray head 39 is provided with cutouts 41 and 42 along a bottom portion of the circumference of the skirt 31. Mounting cup 40 is provided with two raised portions or protrusions 43 and 44 extending in a circumferential direction around base 26. Each raised portion 43 and 44 is separated by an unraised portion 46 and 47 of the base 26. The raised portions 43 and 44 are proportioned to fit within the cutouts 41 and 42 of skirt 31 respectively when the spray head 39 is fitted to mounting cup 40 and when spray head 39 is pushed down. When the spray head 39 is rotated relative to the mounting cup 40, the mating fit up of cutouts 41 and 42 with raised portions 43 and 44 is destroyed such that spray head 39 cannot be depressed and spraying cannot be initiated. By making one pair 41 and 43 of the mating raised portions and cutouts 41 and 43 a different length than that of the other mating pair 42 and 44, only one position of spray head 39 relative to mounting cup 40 will allow for spraying. All other positions of spray head 39 relative to mounting cup 40 will not allow spraying. The bottom edge of skirt 31 will contact the upper surface of a raised portion such that the spray head 39 cannot be depressed sufficiently to open the spray valve fitted to mounting cup 40. A simple position mark 45 on spray head 39 in combination with a position mark 4 on mounting cup 40 will inform a user of the correct alignment to allow spraying in a particular direction. Once spraying is completed, the user may rotate spray head 39 to any other position so that a child or any other person cannot accidently initiate spraying. As seen in FIG. 10 the location of the raised portions 43 and 44 of the embodiment of FIG. 9 is along the circumferential intersection between the inside of the cylindrical wall 27 and the base 26 of mounting cup 40. The length and height of raised portions 43 and 44 is not material provided that whatever lengths and heights are chosen they are consistent with the length and height of cutouts 41 and 42 to allow a mating fit up and provide for spraying. It is to be noted that the invention is not limited to two cutouts and two raised portions, any number, from one to four for example, may be used.

Figure 11:
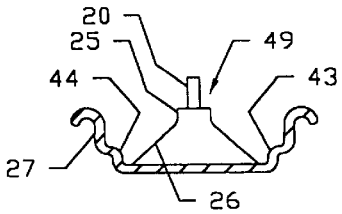
FIG. 11 is a side view of a male mounting cup according to the present invention.
Figure 12:
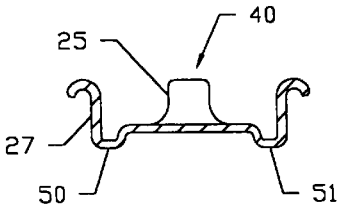
FIG. 12 is a side view of a female mounting cup utilizing depressions.
Figure 13:
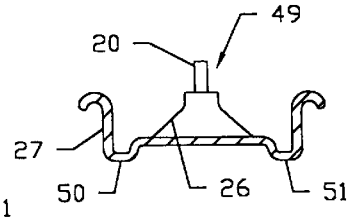
FIG. 13 is a side view of a male mounting cup utilizing depressions.

FIG. 11 illustrates the use of two raised portions 43 and 44 with a male mounting cup 49. FIGS. 12 and 13 illustrate the use of depressions 50 and 51 instead of raised portions. If depressions are used, the spray head is to be provided with extending portions at the bottom end of the skirt 31 to mate with the depressions. In the embodiments of FIGS. 9–13, the skirt 31 of spray head 39 fits within close proximity to the inside of cylindrical wall 27 of mounting cup 40 and 49. However this too is not material to the invention. Any diameter of skirt 32 may be used provided that raised portions 43 and 44 or depressions 50 and 51 coincide in location on the mounting cup and with the diameter chosen so as to provide the above described mating fit between the spray head and the mounting cup.

Figure 14:
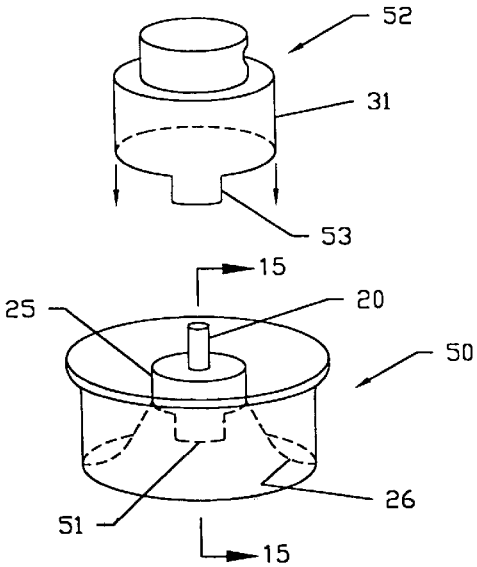
FIG. 14 is a composite view of another embodiment of the present invention for use with a male mounting cup and a small or medium sized spray head.
Figure 15:
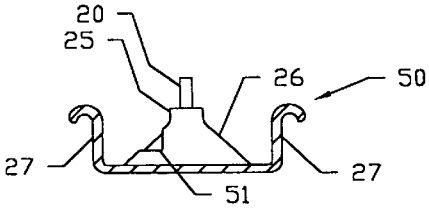
FIG. 15 is a view taken along the lines 15—15 of FIG. 14.

FIGS. 14 and 15 illustrate the use of a male mounting cup 50 as indicated by the angled base 16 and the male stem 20. In this embodiment, a single depression 51 is provided on the angled base 16. The spray head 52 associated with mounting cup 50 includes a small diameter skirt 31 which fits closely over the pedestal 25. An extending portion or tab 53 from skirt 31 is proportioned to fit within depression 51 when the spray head 52 is depressed. Non alignment of tab 53 with depression 51 prevents depression of spray head 52 and spraying cannot occur.

Figure 17:
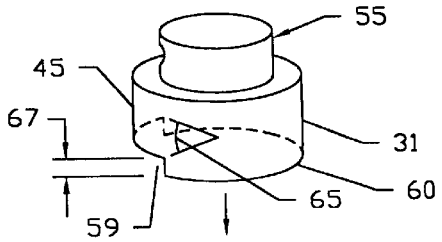
FIG. 17 is a view taken along the lines 17—17 of FIG. 16.
Figure 17:
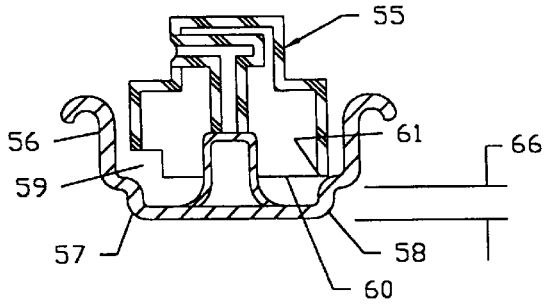
Figure 16:
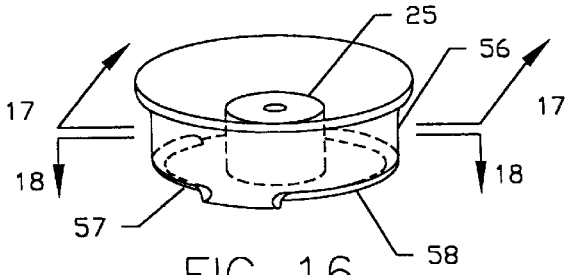
FIG. 16 is a composite view of another embodiment of the present invention.
Figure 18:
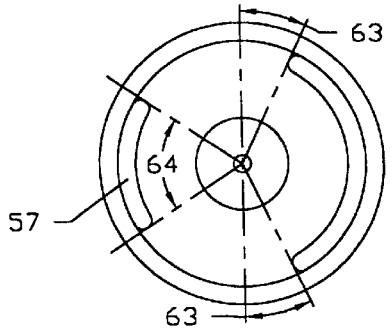
FIG. 18 is a view taken along the lines 18—18 of FIG. 16.

FIGS. 16–18 show another embodiment of the safety spray apparatus. While a female mounting cup 56 is shown, this embodiment is equally applicable to a male mounting cup. Mounting cup 56 is provided with two raised portions (or depressions) 57 and 58. However, the skirt 31 of spray head 58 is provided with a single cutout 59. FIG. 17 schematically shows the mating fit up of spray head 55 with mounting cup 56, when spray head 58 is aligned with mounting cup 56 and positioned for spraying. The bottom edge 60 of skirt 31 is in close proximity or rests on the upper surface of raised portion 58. The cutout 59 is located above and is aligned with raised portion 57. Upon depressing the spray head 55 any clearance space between bottom edge 60 and the upper surface 61 of raised portion 58 is eliminated and contact of edge 60 with raised portion 58 is established. Continued depression of spray head 55 causes a slight tilting of spray head 55 within mounting cup 56 because of the clearance between cutout 59 and raised portion 57. This slight tilting and depression of spray head 55 results in the opening of the valve 21 (not shown) within mounting cup 56 and allows spraying to occur. Too much clearance space between edge 60 and raised portion 58 when spray head 55 is fitted to mounting cup 56 will defeat the safety feature of this embodiment. Also, the clearance space between cutout 59 and raised portion 57 must be properly proportioned to allow spraying. The circumferential length and position of the cutout and the raised portions are other variables in this embodiment. Obviously, a great many combinations of these variables will provide for the intended safety operation of this embodiment. It is a relatively simple trial and error procedure to obtain any number of workable combinations of the variable factors. For example the inventor herein has determined that an angle 63 of approximately 30 degrees shown in FIG. 18 between a horizontal centerline and the ends of raised portion 58, an included angle 64 of raised portion 57 of approximately 25 degrees, an included angle 65 of approximately 30 degrees (shown in FIG. 16) for cutout 59, an approximate height 66 of 2.0 mm to 2.5 mm for raised portions 58 and 57 and a height of approximately 3.0 mm for cutout 59, provide for a satisfactory and workable combination.

Figure 20:
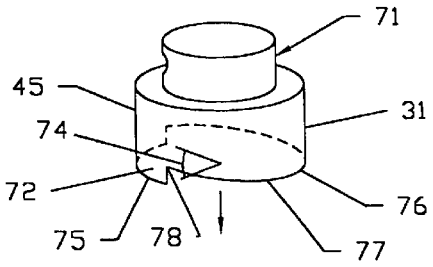
FIG. 20 is a view taken along the lines 20–30 of FIG. 19.
Figure 20:
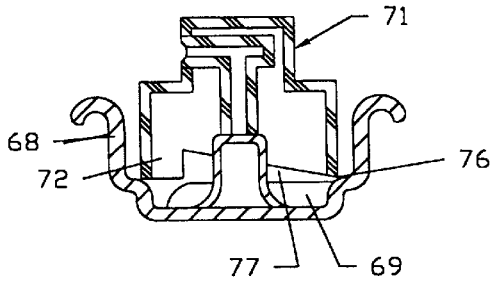
Figure 19:
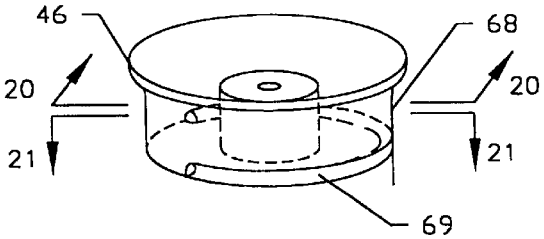
FIG. 19 is a composite view of another embodiment of the present invention.
Figure 21:
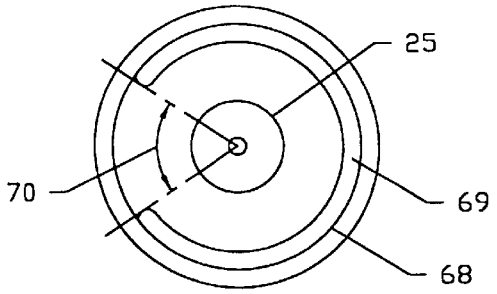
FIG. 21 is a view taken along the lines 21—21 of FIG. 19.
Figure 22:
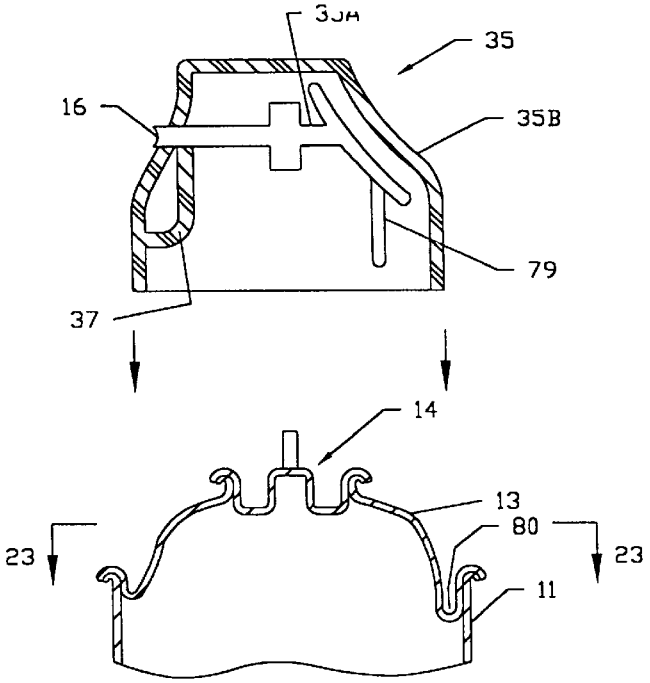
FIG. 22 is a composite view of an embodiment of the present invention used with a combination spray through overcap.
Figure 23:
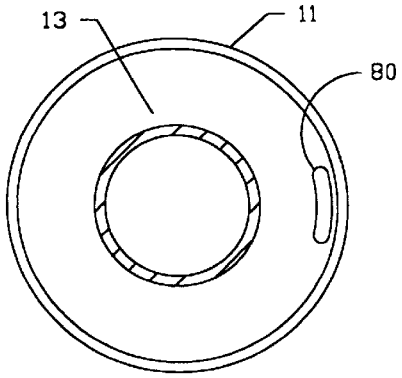
FIG. 23 is a cross sectional view taken along the line 23—23 of FIG. 22.
Figure 26:
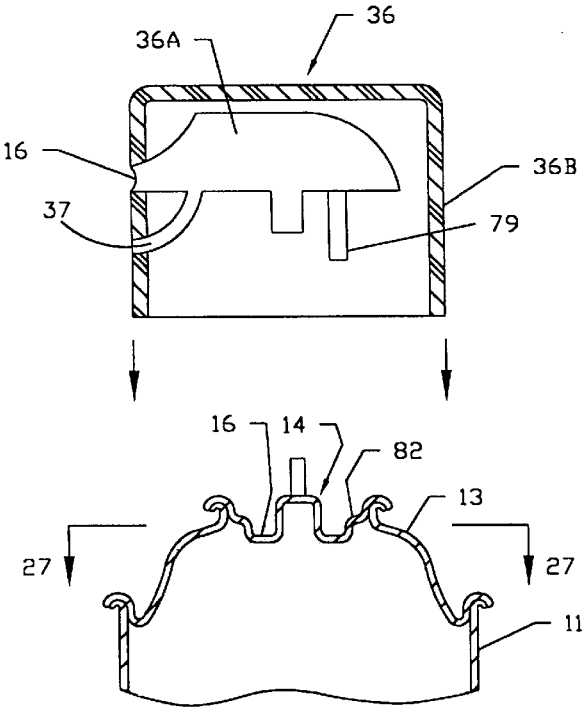
FIG. 26 is a composite view of an embodiment of the present invention used with another type of a spray through overcap.
Figure 27:
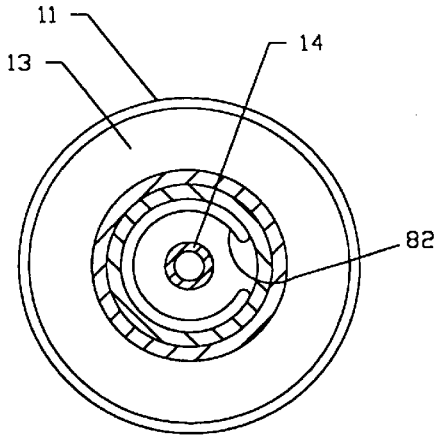
FIG. 27 is a cross sectional view taken along the line 27—27 of FIG. 26.

FIGS. 19–21 show yet another embodiment of the present invention. This embodiment also functions for both a male-female and a female-male combination of the spray head and mounting cup. A mounting cup 68 includes a single raised portion 69 where the included angle 70 between the ends of raised portion 69 is approximately 30 degrees. Spray head 71 includes a single extending portion 72 from skirt 31 with the included angle 74 being of the order of 25 degrees. Raised portion 69 may have a height of approximately 2.0 mm to 2.5 mm, extending portion 72 may have a height of 2.5 mm. The lower edge 75 of extending portion 72 and pivoting point 76 of the edge of skirt 73, which is diametrically opposite from the center of the extending portion 72, are substantially co-planer. The remaining edge portions 77 of skirt 31 from pivot point 76 to extending portion 72 each slope upward to intersect with the upper vertical edge 78 of extending portion 72. The operation of the embodiment of FIGS. 19–21 is the same as the operation of the embodiment of FIGS. 16–18 i.e., spraying can occur only in one direction when the spray head is properly aligned with the mounting cup. With either of these two embodiments, rotation of spray the head relative to the mounting cup prevents spraying. The correct direction of spraying can be indicated by a mark 46 on the mounting cups (or on the container 11). Another mark 45 on the spray heads when aligned with the mark 46 will indicate the ability to spray. By simply misaligning of the marks after spraying, accidental spraying cannot occur.

FIGS. 22 through 29 show further embodiments of the present invention as adapted to a spray through overcap. It is to be noted that the spray through overcap of the prior art initiates spraying by depressing the spray head in accordance with a hinged joint 37 attached to the orifice 16. By depressing the actuator 35A or 36A, the hinged joint allows the actuator assembly to pivot which both bends and depresses the valve stem and opens the spray valve.

In the embodiments of FIGS. 22 through 29, an extending member 79 is attached to the actuator 35A or 36A of the combination spray head and over cap 35 or 36. A depression 80 is provided in the surface of the can cover 13 in the embodiment of FIG. 22 and in line with the end of extending member 79. Said depression 80 having an open ended annular configuration extending around said can cover 13 for a distance less than one half of the circumfrence at that location. When assembled and positioned for spraying, the end of extending member 79 fits within the depression 80 allowing the spray head to be sufficiently depressed to open the spray valve. When the spray through overcap is at any other position, spraying cannot occur due the interference of the end of extending member 79 with the un-depressed portion of the can cover between the ends of depression 80.

Figure 24:
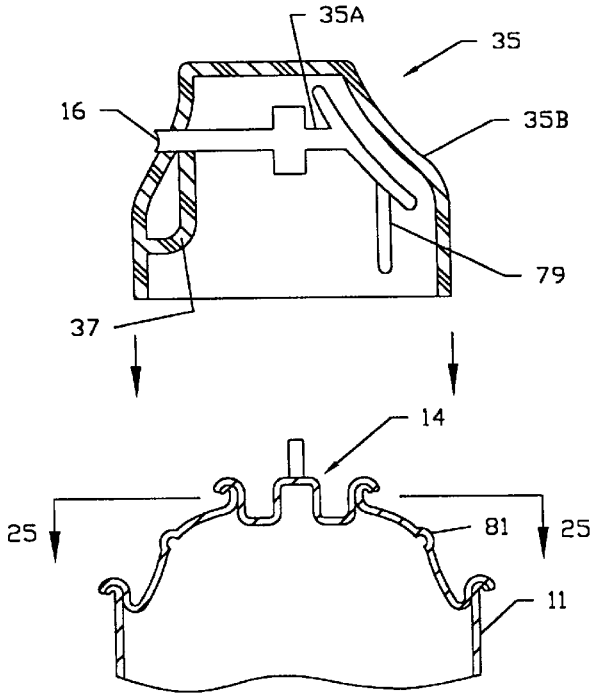
FIG. 24 is a composite view of another embodiment of the present invention used with the combination spray through overcap of FIG. 22.
Figure 25:
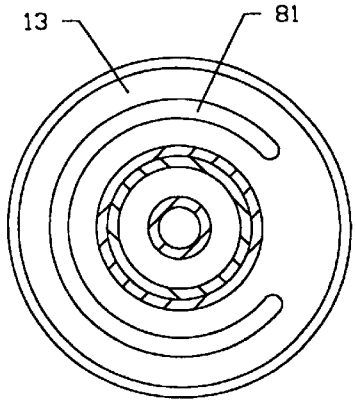
FIG. 25 is a cross sectional view taken along the line 25—25 of FIG. 24.
Figure 28:
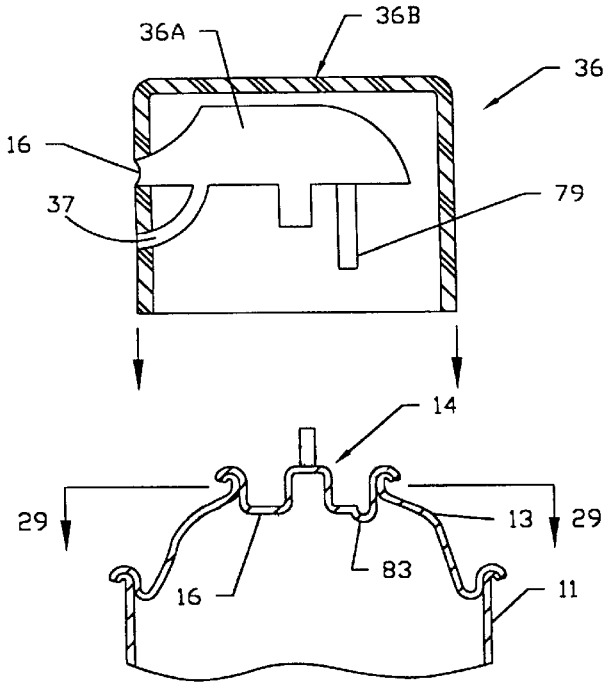
FIG. 28 is a composite view of another embodiment of the present invention used with the combination spray through overcap of FIG. 26; and, FIG. 29 is a cross sectional view taken along the line 23B—23B of FIG. 28.
Figure 29:
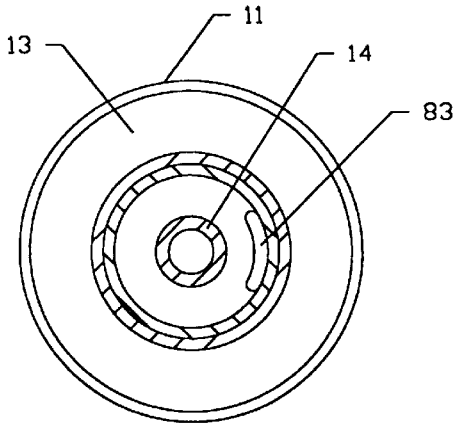

In the embodiment of FIG. 24 a raised surface 81 is provided in the can cover. FIG. 25 shows that the raised portion 81 comprises an open ended annular member which extends for more than one half of the circumfrence at that location on the top of the can cover 13. The resulting unraised portion of the annular raised surface is proportioned to fit therebetween the end of extending member 79. When assembled and positioned for spraying, the end of extending member 79 fits between the unrasied portion of annular member 81 allowing the spray head to be sufficiently depressed to open the spray valve. When the spray through overcap is at any other position, spraying cannot occur due the interference of the end of extending member 79 and the raised portion 81.

FIGS. 26 through 29 show the use of an annular raised portion 82 and a depression 83 but within the mounting cup 14. As with the embodiments of FIGS. 22 through 25, spraying can occur only when the extending member 79 is aligned with the unraised portion between the ends of annular member 82 or when aligned with the depression 83. When spray through overcap 36 is rotated to any other position, the end of extending member 79 is in substantial contact with the raised annular surface 82 or the unraised portion between the ends of depression 83 such that the valve stem cannot be depressed and therefore the spray valve cannot open.

Thus, in the embodiments of FIGS. 22 through 29, spraying can be initiated only when the spray through overcap and therefore the end of extending member 79 is rotated to be aligned with the depressions 80 or 83, or when the end of extending member 79 is aligned with the unraised portions betwen the ends of raised annular members 81 or 82.

It is to be further noted that the above embodiments utilize the material of the mounting cups or the can cover to form the depressions or the raised surfaces. An obvious alternative is to use a separate insert mounted within the mounting cups or on the can cover to form the raised surface.

In accordance with the above description it is seen that the safety feature provided by the present invention is accomplished by a mating spray head and mounting cup. One or more raised surfaces or depressions are provided on the mounting cup. One or more cutouts or extending members are provided or the spray head. When mating of the raised surface with the depression or mating of the depressions with the extending members, occurs, spraying may be initiated and maintained by depressing the spray head. When the spray head is rotated about its longitudinal axis relative to the longitudinal axis of the mounting cup, the mating relationship is eliminated and the spray head cannot be depressed to initiate or maintain spraying.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breach and scope of the claims here appended.

I claim:

1. Safety apparatus adapted to be used with an aerosol spray can comprising a spray through overcap and a mounting cup, said overcap being attachable to said spray can, said mounting cup also being attached to said spray can and comprising a cylindrical member having a cylindrical wall substantially closed at one end, a raised surface portion on said substantially closed end and within said cylindrical wall comprising a portion of an annulus, said spray through overcap having an actuator with a downwardly extending member which is configured to operatively register with said raised surface portion on said substantially closed end of said mounting cup, said spray through overcap being fitted to said spray can and being fully rotatable relative to said spray can about a longitudinal axis thereof, whereby spraying can be actuated only when the spray through overcap and the mounting cup are in one relative position.

2. The safety can apparatus of claim 1, wherein said raised surface portion on said substantially closed end of said mounting cup extends in a circumfrential direction for a length greater than one-half of the inner circumference of said cylindrical mounting cup wall, leaving an unraised portion between ends thereof, said member extending from said actuator and proportioned to fit within said unraised portion on said mounting cup, whereby spraying can be initiated only when said extending member is aligned with said unraised portion.

3. Safety apparatus adapted to be used with an aerosol spray can comprising a spray through overcap and a can cover, said spray through overcap being attachable to said spray can, said can cover also being attached to said spray can and comprising a convexly shaped dome having a spray valve at a top center thereof, a raised surface portion on said dome comprising a portion of an annulus, said spray through overcap having an actuator with a downwardly extending member which is configured to operatively register with said raised surface portion on said dome, said spray through overcap being fully rotatable relative to said spray can about a longitudinal axis thereof, whereby spraying can be actuated only when the spray through overcap and the spray can are in one relative position.

4. The safety can apparatus of claim 3, wherein said raised surface portion on said can cover extends in a circumfrential direction for a length greater than one-half of the circumference of said can cover at a radial location of said raised surface, leaving an unraised portion between ends thereof, said member extending from said actuator and proportioned to fit within said unraised portion on said dome, whereby spraying can be initiated only when said extending member is aligned with said unraised portion.

5. Safety apparatus adapted to be used with an aerosol spray can comprising a spray through overcap and a can cover, said spray through overcap being attachable to said spray can, said can cover also being attached to said spray can and comprising a convexly shaped dome having a spray valve at a top center thereof, a depressed surface portion on said dome comprising a portion of an annulus, said spray through overcap having an actuator with a downwardly extending member which is configured to operatively register with said depressed surface portion on said dome, said spray through overcap being fully rotatable relative to said spray can about a longitudinal axis thereof, whereby spraying can be actuated only when the spray through overcap and the spray can are in one relative position.

6. The safety can apparatus of claim 5, wherein said depressed surface portion on said can cover extends in a circumfrential direction for a length less than one-half of the circumference of said can cover at a radial location of said depressed surface, leaving an undepressed portion between ends thereof, said member extending from said actuator and proportioned to fit within said depressed portion on said dome, whereby spraying can be initiated only when said extending member is aligned with said depressed portion.

* * * * *